US006756531B2

(12) United States Patent
Ruan

(10) Patent No.: US 6,756,531 B2
(45) **Date of Patent: *Jun. 29, 2004**

(54) VIOLIN SHOULDER CRADLE

(76) Inventor: Ying Gang Ruan, 12014 W. 130th St., Overland Park, KS (US) 66213

( * ) Notice: Subject to any disclaimer, the term of this patent is extended or adjusted under 35 U.S.C. 154(b) by 0 days.

This patent is subject to a terminal disclaimer.

(21) Appl. No.: 10/198,715

(22) Filed: Jul. 16, 2002

(65) Prior Publication Data

US 2004/0011182 A1 Jan. 22, 2004

(51) Int. Cl.[7] ..... G10D 1/02
(52) U.S. Cl. ..... 84/278; 84/279; 84/280
(58) Field of Search ..... 84/278, 279, 280

(56) References Cited

U.S. PATENT DOCUMENTS

| | | | | | |
|---|---|---|---|---|---|
| 156,613 | A | | 11/1874 | White | |
| 217,330 | A | | 7/1879 | Bull | |
| 550,386 | A | | 11/1895 | Davis | |
| 576,950 | A | | 2/1897 | Coloney | |
| 5,415,070 | A | | 5/1995 | Kaman | |
| 5,883,315 | A | * | 3/1999 | Kaplan et al. | 84/279 |
| 6,031,163 | A | | 2/2000 | Cullum et al. | |
| 6,278,044 | B1 | | 8/2001 | Ruan | |

* cited by examiner

*Primary Examiner*—Shih-Yung Hsieh
(74) *Attorney, Agent, or Firm*—Hovey Williams LLP

(57) ABSTRACT

A violin shoulder cradle is designed for coupling to a violin to provide improved ergonomics and quality of sound when the violin is played. The violin shoulder cradle includes a shoulder support and coupling structure for attaching the cradle to the violin. The shoulder support includes a resonance chamber which is hollow for adding to the beauty of the sounds of the violin without detracting from the appearance of the violin during playing.

20 Claims, 3 Drawing Sheets

VIOLIN SHOULDER CRADLE

BACKGROUND OF THE INVENTION

1. Field of the Invention

This invention broadly concerns a shoulder cradle useful for violins, violas and similar stringed instruments intended for support on the shoulder of the musician. More particularly, it is concerned with an ergonomically configured shoulder cradle which includes a resonance chamber to enhance the quality of the sound generated when the stringed instrument is played.

2. Description of the Prior Art

Violins and other stringed instruments produce tones when a bow is drawn across the strings, known as arco, or when the strings are finger-plucked (pizzacato). As used herein, "violin" is intended to include similar instruments such as violins of reduced size, such as half or three-quarter sized violins, and violas, where the instrument is typically positioned between the shoulder and chin of the musician. The violin produces a sympathetic vibration between the instrument's belly and back, which adds volume and resonance to the sound produced by the vibration of the strings. A chin rest is typically provided adjacent the tail piece between the between belly of the violin body which provides a support between the musician's chin and the violin body.

Shoulder rests have sometimes been used between the violin body and the musician's shoulder. In the simplest form, the cushion includes a small fabric or elastic cushion which if held between the back of the violin body and the shoulder of the wearer. These shoulder rests help to support the violin against the shoulder of the wearer whereby the hard wooden back of the violin is separated from the musician's shoulder. However, they have lacked features which would inhibit the violin from slippage on the shoulder and which promote proper playing position. Further, the shoulder rests of the prior art have not contributed to the quality of the tones produced by the violin except insofar as the rest contributes to the comfort of the musician and thereby improves the performance.

There has thus developed a need for a violin shoulder cradle with improved ergonomics in adding to the comfort of the musician during the performance.

There has also developed a need for a violin shoulder cradle which while supporting the instrument on the musician's shoulder, improves the resonance of the tones or sounds produced by the instrument.

SUMMARY OF THE INVENTION

These and other objects of the present invention are largely met by the violin shoulder cradle of the present invention. That is to say, the violin shoulder cradle hereof not only inhibits slippage of the instrument from the musician's shoulder and promotes the maintenance of the violin in the proper playing position, but further is ergonomically configured for comfort and precise conformation to the shoulder of the musician, minimizes the possibility of damage to the violin during coupling and decoupling, provides an attractive appearance, and improves the quality of the sound or tones of the violin when it is played.

Broadly speaking, the violin shoulder cradle hereof shares many of the same features shown in my U.S. Pat. No. 6,278,044, the disclosure of which is incorporated herein by reference, in that it includes a base having a foundation body mounting a pad, the base further mounting gripping legs for coupling and decoupling to a violin without the necessity of tools. The body is especially configured to present an upper surface and a lower surface in use, two longitudinally spaced ends and a proximate edge and a remote edge. The terms "upper surface", "lower surface", "proximate edge" and "remote edge" are herein intended to refer to the relative position of the surfaces when the violin shoulder cradle is mounted to a violin and in place on the musician's shoulder. The upper surface may be relatively planar or of any other configuration compatible for mounting in a facing relationship to the violin, whereas the lower surface is contoured and thus configured for the comfort and proper positioning on the shoulder of the musician. A waist of reduced thickness between the upper surface and lower surface of the foundation is positioned intermediate the two ends to facilitate the comfort of the musician and proper playing position, while the lower surface includes one or more stepped shelves. The stepped shelves, covered by the pad, engage the musician's shoulder and clavicle, thereby providing levels of engagement in contrast to a surface without such shelves which is prone to slippage and less likely to yield proper positioning of the violin in use.

Additionally, the arms coupled to the base extend laterally to firmly grasp the instrument, thereby providing a solid and unitary platform to rest on the musician's shoulder. At least one of the legs is yieldably and thus adjustably coupled to the base to permit the musician to not only accomodate differences in size of the instrument but further to avoid damage to the instrument during coupling and decoupling. The cradle will enable the musician to be more relaxed during performing, thereby accomodating good technique and allowing the musician to comfortably play longer and better.

In preferred embodiments, the foundation of the base includes a shell defining therein a hollow resonance chamber. The resonance chamber enhances the depth and quality of the sounds and tones of the instrument in that the foundation is positioned closely adjacent the back of the instrument so that the resonance chamber contributes to the resonance without altering the pitch of the sounds. The foundation preferably includes at least one port in the shell to allow passage of the sound from the resonance chamber. The at least one port provides an additional advantage, in that it permits that portion of couplers which connect and attach the legs to the foundation to be positioned within the resonance chamber while a leg passes through the port, thereby contributing to the appearance of the shoulder cradle and enabling the positioning of resilient cushions to placed between the foundation and the back of the instrument.

These and other advantages will be readily apparent to those skilled in the art with reference to the drawings and description which follow.

DESCRIPTION OF THE PREFERRED EMBODIMENTS

Figure 1:
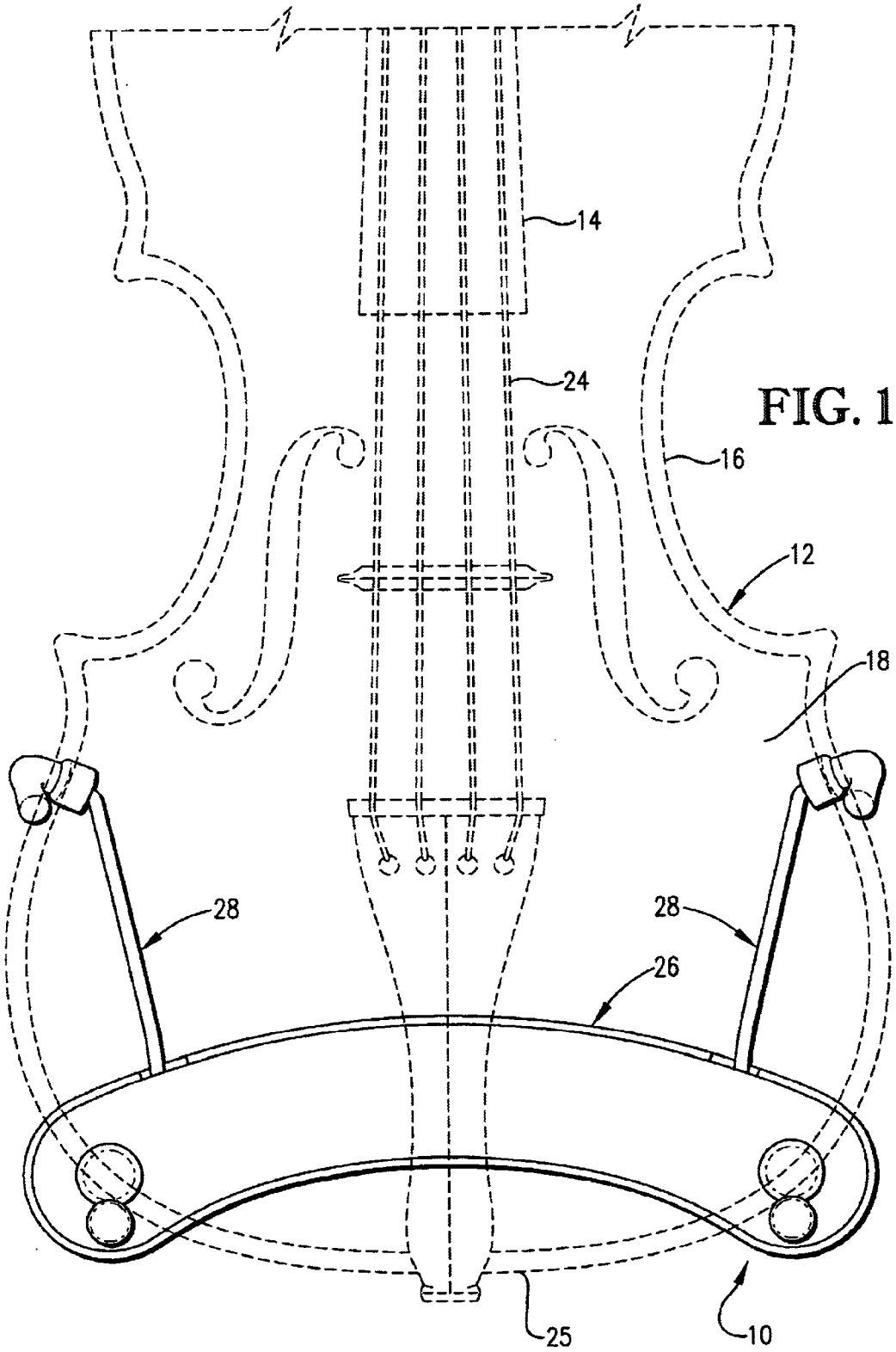
FIG. 1 is a top plan view of the violin shoulder cradle hereof when in a position for use, showing the top of the foundation, the legs of the couplers, the cushions, and a part of a violin shown in dashed lines for viewing the cradle.
Figures 2, 3:
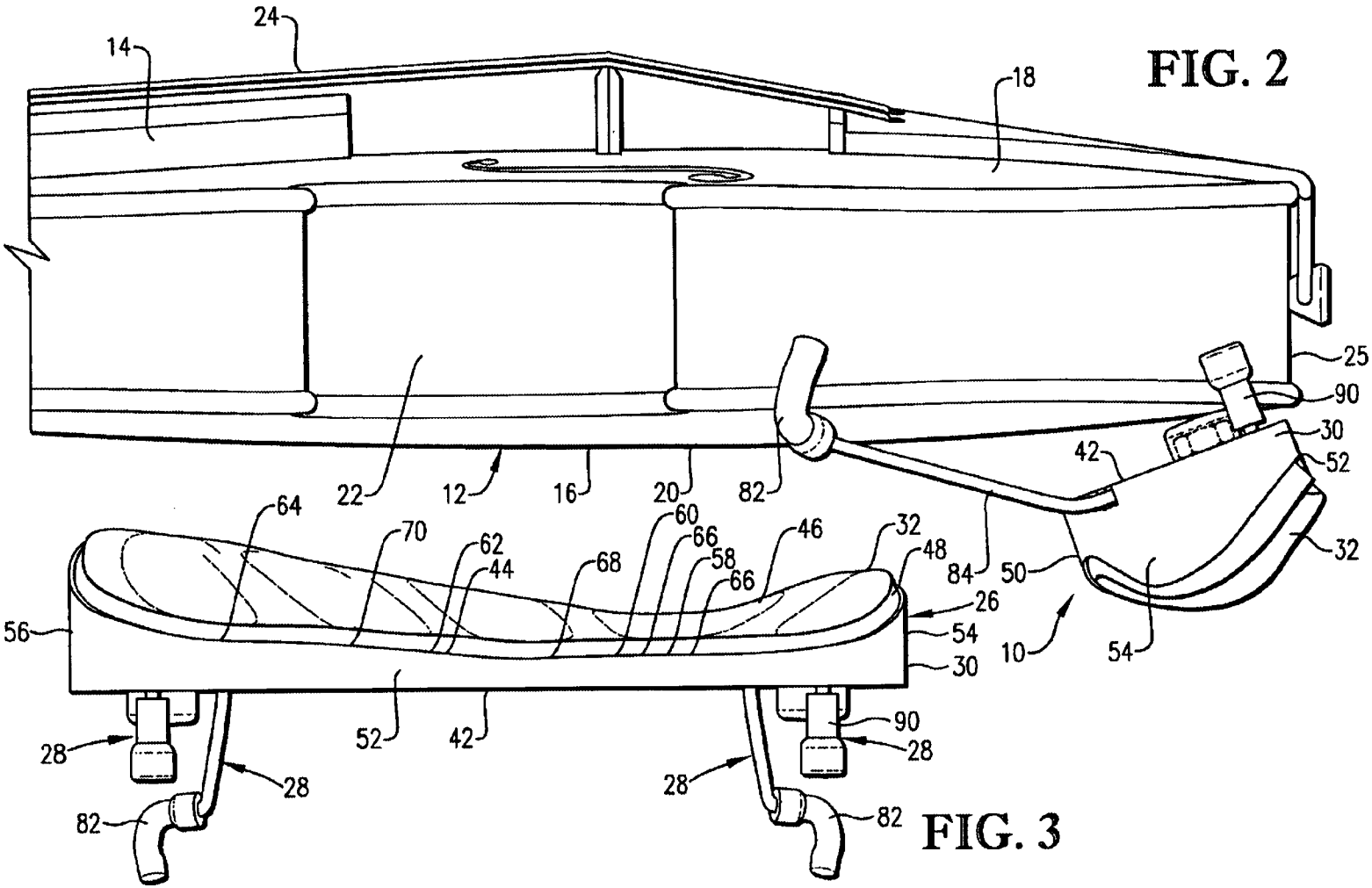
FIG. 2 is a end elevational view of the violin shoulder cradle hereof showing one end of the foundation with a fixed leg and a yieldable leg lying in engagement with the violin body.
FIG. 3 is an inverted side elevational view of the violin shoulder cradle hereof showing the proximate edge of the base.

Referring now to the drawing, wherein the descriptions of the identified members are made in reference to their normal orientation during use, the violin shoulder cradle 10 of the present invention is adapted for violin 12 shown in dashed lines in FIG. 1 and in solid lines in FIG. 2. The violin includes a neck 14 corresponding to a central longitudinal axis of the violin 12 and is normally positioned away from the neck of the musician, and a body 16. The body has a belly 18 with a chin rest positioned on the belly 18 of the body 16, and a back 20 opposite the belly and spaced therefrom by a surrounding rib 22. It is to be understood that the body 20 is substantially hollow, having a cavity defined between the belly 18 and the back 20 and surrounded by the rib. Strings 24 extend from the tail piece adjacent the bottom end 46 of the body 16 and extend in a substantially longitudinally centered position across the belly 18 and along the neck to a remote end of the neck as illustrated in FIGS. 1 and 2. The strings 24 vibrate when plucked or when a bow is drawn across the strings, producing the sound generated by the violin.

The cradle 10 is configured to be coupled to the violin 12 so as to lie along the back 20 of the body 16 adjacent the bottom end 25 of the body 16, and between the shoulder of the musician and the body 16. The cradle 10 broadly includes a shoulder support 26 and coupling structure 28 for attaching the shoulder support 26 to the violin 12 without the need for any tools.

Figure 4:
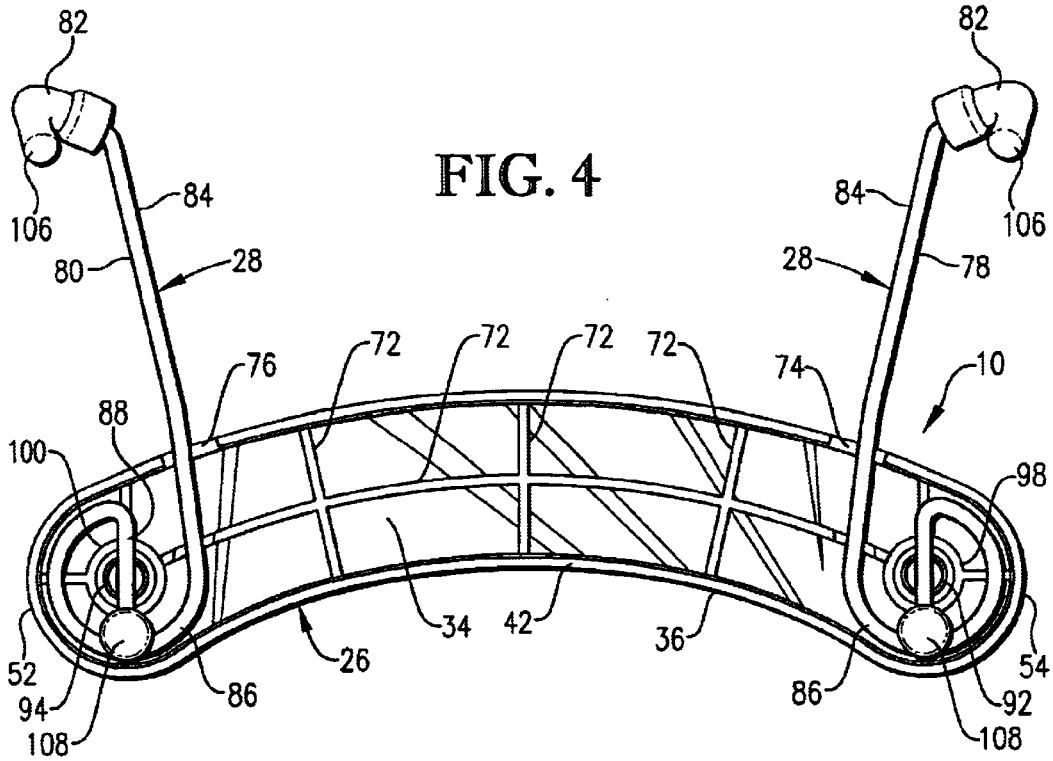
FIG. 4 is a top plan view of the violin shoulder cradle hereof with the base plate removed to show the resonance chamber and the mounting of the couplers to the foundation.
Figure 5:
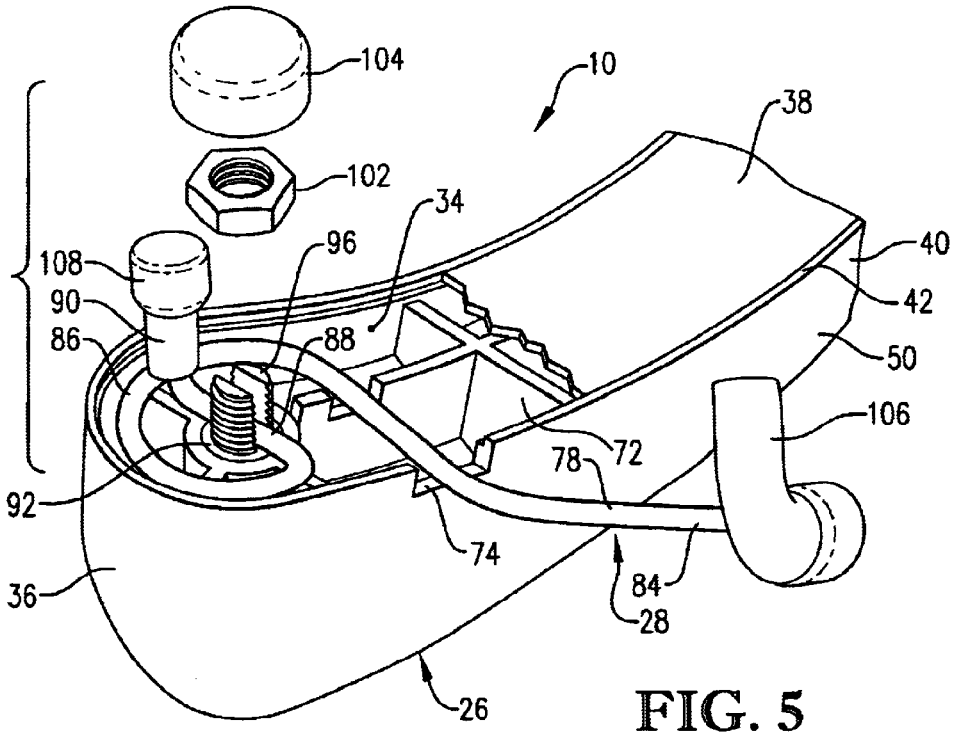
FIG. 5 is a fragmentary, exploded, perspective view of the violin shoulder cradle hereof with a portion of the base plate broken away to show the passage of one of the legs through a port and showing the cushion for covering the nut holding the base plate of the foundation in position.

The shoulder support 26 preferably includes foundation 30 and a pad 32. The foundation 30 defines and encloses a hollow resonance chamber 34, the foundation including a shell 36 and a base plate 38. The shell 36 may be constructed of synthetic resin, metal or wood, the latter providing especially pleasing tones. The shell 36 has a surrounding side wall 40 with an open upper margin 42 which receives the base plate, and a lowermost support wall 44 for receiving thereon a resilient, cushioning pad 32 of synthetic rubber or the like. The surrounding side wall 40 extends downwardly slightly below the lowermost support wall 44 to provide a rim 48 around the lowermost support wall 44 and within which the pad 46 is received. As described in U.S. Pat. No. 6,278,044, the lowermost support wall 44 and the pad 46 received thereon are generally sloped from a remote side 50 of the foundation 30 oriented generally away from the musician's neck to a proximate side 52 of the foundation 30 oriented generally toward the musician's neck. That is, the distance between the lowermost support wall 44 and the upper margin 42 is generally greater along the remote side 50 than along the proximate side 52 directly across therefrom. The foundation 30 also has a first end 54 and a second end 56 which are enlarged and thus thicker than a midsection 58 intermediate the first and second ends. Again, this is to say that the distance between the lowermost support wall 44 and the upper margin 42 is generally greater at the first end 54 and the second end 56 than at the midsection 58 therebetween along the corresponding remote side 50 and proximate side 52, thus taking into account the slope of the lowermost support wall from the remote side to the proximate side. As described in my U.S. Pat. No. 6,278,044, the lowermost support wall includes stepped shelves 60, 62 and 64 of gradually increasing distance from the base plate 38, with a waist 66 of minimal distance from the base plate at approximately the midsection 58. The shelves 60, 62 and 64 and the waist 66 are separated by respective ridges 66, 68 and 70 having greater slopes along an axis from first end 54 to second end 56. As seen in FIGS. 4 and 5, the shell 36 may include a plurality of reinforcing partitions 72 which aid in providing rigidity to the foundation 30.

The base plate 38 may be of wood, synthetic resin or most preferably of metal such as gold plated brass to provide the best sound quality. The base plate 38 in cooperation with the shell 36 substantially encloses the resonance chamber 34. The side wall 40 preferably includes two ports 74 and 76. The ports 74 and 76 not only accommodate the passage of legs 78 and 80, respectively, of the coupling structure 28 from the resonance chamber 34 through the side wall 40 for permitting attachment of the cradle 10 to the violin 12, but also provide for the passage of resonant sound from the chamber 34 to the environment. The ports 74 and 76 are thus larger, preferably side edge to side edge, than the diameter of the wire used for the legs 78 and 80 which enables the legs 78 and 80 to shift laterally for grasping onto the violin body 16 and at the same time always provide a clearance between the legs 78 and 80 and the shell 36 for the passage of sound therethrough. However, in the most preferred embodiments, the base plate 38 cooperates with the portion of the shell 36 defining the ports 74 and 76 for inhibiting movement of the legs 78 and 80 in a direction toward and away from the base plate 38 so as to enhance stability of the cradle 10 when mounted to the violin body 16.

The legs 78 and 80 are part of the coupling structure 28, each leg including a remote terminal bend 82 oriented generally upwardly when the violin is in a standard playing position, as shown in FIG. 5, FIG. 3 being an inverted view. Each leg further includes an elongated stretch 84, an internal biasing loop 86, a mounting bight 88, and a proximate terminal bend 90 as seen in FIGS. 4 and 5. The biasing loop 86 provides a degree of resiliency so that the remote terminal bend 82 may readily clamp onto the violin body 16 when mounted. The proximate terminal bend 90 extends through a hole in the base plate 38 as seen in FIGS. 1, 2 and 3, the base plate thus maintaining the proximate terminal bend 90 in a relative fixed position without substantial flexibility. The coupling structure 28 further includes respective bolts 92 and 94 each having a slotted head 96 for receiving the mounting bight 88 therein. The slots of the slotted heads 96 are preferably about the width of the wire used for the legs, so that the bight 88 is held against shifting within the slot. The bolts 92 and 94 are threaded or held by adhesive in receivers 98 and 100 of the foundation, the receivers being located which in the interior to the foundation 30 and thus within the resonance chamber 34. The slotted heads 96 extend through holes in the base plate 38, the base plate being held in place by nuts 102 threaded onto the slotted heads to hold the base plate 38 and thus the bights 88 there beneath in position. A resilient bumper cap 104 of rubber or the like covers the nuts 102 and the slotted heads 96 and resilient socks 106 and 108 also of rubber or the like cover the respective remote terminal bends 82 and the proximate terminal bends 110 to resist damaging the violin body 16 when mounting the cradle 10 thereon.

After assembly, the cradle 1O is mounted onto the back 20 of the violin body 18 simply by pushing the remote terminal bends 82 of the legs 78 and 80 apart from one another, whereby the violin body 12 is grasped between the remote terminal bends 82 and the proximate terminal bends 90 in the position shown in FIGS. 1 and 2. The violin body 16 is able to rest on the bumper cap 104 as shown in FIG. 2 without damaging the finish of the violin 12. Once mounted, the cradle 10 promotes a correct playing position for the musician by orienting the violin 12 with its neck extended substantially horizontal, and improved comfort is provided to the musician by the ergonomic configuration of the foundation 30. In addition, the beauty of the sound produced by the violin 12 is enhanced by the provision of an acoustic resonance chamber 34 within the cradle. The depth of the sound of the violin 12 when played is improved without the addition of any powered devices or structure which detracts from the artistic appearance of the musician and the beauty of the violin.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

What is claimed is:

1. A shoulder cradle for supporting a stringed instrument on the shoulder of a musician, the stringed instrument having a neck defining a longitudinal axis, said cradle comprising:

a shoulder support having a shell and a base plate substantially enclosing a resonance chamber, said shell including a reinforcing partition within said resonance chamber; and coupling structure for attaching the cradle to the stringed instrument.

2. A shoulder cradle as set forth in claim 1, wherein said shell includes a lowermost support wall and a side wall bordering said resonance chamber.

3. A shoulder cradle as set forth in claim 1, said shoulder support including at least one port in said shell for permitting passage of a part of said coupling structure therethrough.

4. A shoulder cradle as set forth in claim 1, said coupling structure including a pair of legs coupled to said shoulder support.

5. A shoulder cradle as set forth in claim 4, said coupling structure including at least one threaded member coupled to said shoulder support for attachment of one of said legs.

6. A shoulder cradle as set forth in claim 5, wherein the threaded member is a slotted bolt and one of said legs is held by said slotted bolt.

7. A shoulder cradle as set forth in claim 5, wherein said shoulder support includes a base plate, said base plate being positioned over said threaded member for retaining the position of the legs.

8. A shoulder cradle as set forth in claim 7, wherein at least a portion of said one of said legs passes through and is held by said base plate.

9. A shoulder cradle as set forth in claim 8, wherein said shoulder support includes a port, and wherein another portion of said one of said legs passes through said port.

10. A shoulder cradle for supporting a stringed instrument on the shoulder of a musician, the stringed instrument having a body and a neck defining a longitudinal axis, said cradle comprising:

a shoulder support configured for resting on a musician's shoulder; and coupling structure for attaching the cradle to a stringed instrument, said coupling structure including first and second elongated legs, at least one of said legs being coupled to the shoulder support and yieldable for lateral shifting and grasping onto the body of the stringed instrument.

11. A shoulder cradle as set forth in claim 10, wherein said at least one of said legs includes a biasing loop for providing resiliency for clamping of said one of said legs onto the body of the stringed instrument.

12. A shoulder cradle as set forth in claim 11, wherein said biasing loop is positioned within the shoulder support.

13. A shoulder cradle as set forth in claim 10, said coupling structure including at least one threaded member coupled to said shoulder support for attachment of one of said legs.

14. A shoulder cradle as set forth in claim 13, wherein the threaded member is a slotted bolt and one of said legs is held by said slotted bolt.

15. A shoulder cradle as set forth in claim 13, wherein said shoulder support includes a base plate, said base plate being positioned over said threaded member for retaining the position of the legs.

16. A shoulder cradle as set forth in claim 15, wherein at least a portion of said one of said legs passes through and is held by said base plate.

17. A shoulder cradle as set forth in claim 10, wherein said shoulder support includes a sidewall having a port, and wherein at least a portion of one of said legs passes through said port.

18. A shoulder cradle for supporting a stringed instrument on the shoulder of a musician, the stringed instrument having a body and a neck defining a longitudinal axis, said cradle comprising:

a shoulder support including a side wall having a port; and coupling structure for attaching the cradle to the stringed instrument, said coupling structure including a pair of enlongated arms, at least a part of one of the arms extending through said port and having a terminal bend for engagement with the body of the stringed instrument.

19. A shoulder cradle as set forth in claim 18, wherein said side wall includes two laterally spaced ports, and wherein at least a part of each arm extends through a respective one of said ports.

20. A shoulder cradle as set forth in claim 18, wherein the shoulder support includes a base plate and a shell, the side wall being provided on the shell, the base plate and shell substantially enclosing a chamber, and wherein at least another part of one of said arms extends through said base plate.

* * * * *